US008082834B1

(12) United States Patent
Gordon et al.

(10) Patent No.: US 8,082,834 B1
(45) **Date of Patent: *Dec. 27, 2011**

(54) AMMUNITION MAGAZINE BOX WITH ADJUSTABLE TILTED INTERIOR BRACKET STRUCTURE

(75) Inventors: William F. Gordon, Frisco, TX (US); Michael F. Ingersoll, Hampton, VA (US); David C. Ussery, Fort Worth, TX (US); Caleb J. Rankin, Allen, TX (US); Nathan P. Whitworth, Princeton, TX (US); James A. Hardin, McKinney, TX (US)

(73) Assignee: Contract Fabrication and Design, LLC, Princeton, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/027,635

(22) Filed: Feb. 15, 2011

Related U.S. Application Data

(63) Continuation of application No. 12/050,610, filed on Mar. 18, 2008, now Pat. No. 7,918,153.

(60) Provisional application No. 60/916,371, filed on May 7, 2007.

(51) Int. Cl.
*F41A 9/79* (2006.01)

(52) U.S. Cl. ..... 89/33.14

(58) Field of Classification Search ..... 89/33.14, 89/33.16, 33.2, 33.25, 35.01, 35.02
See application file for complete search history.

(56) References Cited

U.S. PATENT DOCUMENTS 2,494,564 A 1/1950 Lambert
2,573,774 A 11/1951 Sandberg
2,710,561 A 6/1955 Dowd
2,951,422 A 9/1960 Bobkowski
3,060,809 A 10/1962 Tschumi
3,387,536 A 6/1968 Kelley et al.
3,608,426 A 9/1971 Jackson, Jr.
3,986,286 A 10/1976 Stangel
4,036,102 A 7/1977 Marrotte et al.
4,137,820 A 2/1979 Clemens
4,342,253 A 8/1982 Kirkpatrick et al.
4,401,008 A 8/1983 Walker, Jr.
4,468,875 A 9/1984 Harrison et al.
4,492,144 A 1/1985 Dix
4,566,580 A 1/1986 Aloi et al.

(Continued)

OTHER PUBLICATIONS

United States Office Action, Office Action of Jul. 20, 2010, U.S. Appl. No. 12/050,610, 10 pages.

(Continued)

*Primary Examiner* — Bret Hayes
(74) *Attorney, Agent, or Firm* — Haynes and Boone, LLP

(57) ABSTRACT

An ammunition magazine box is provided for receiving a vertically serpentined length of belted ammunition for selective outfeed from the box to a machine gun. A specially designed support bracket structure, representatively of a length adjustable construction, is provided and suitably secured within the interior of the magazine box. At least a portion of the belted ammunition loops rest on a top side surface of the installed support bracket structure. The top support bracket structure side surface is (1) laterally sloped, in a direction transverse to the lengths of the belt loops, to inhibit a tilting-created intermeshing of vertically adjacent projectile ends of the ammunition rounds which could cause a feed jam, and/or (2) longitudinally sloped, in a direction parallel to the lengths of the belt loops, to desirably lessen the ammunition outfeed force that must be exerted by the machine gun.

15 Claims, 3 Drawing Sheets

U.S. PATENT DOCUMENTS

| | | | | |
|---|---|---|---|---|
| 4,572,351 | A | 2/1986 | Golden | |
| 4,573,395 | A | 3/1986 | Stoner | |
| 4,676,138 | A | 6/1987 | Thomson et al. | |
| 4,798,123 | A | 1/1989 | Svanström | |
| 4,876,940 | A | 10/1989 | Aloi et al. | |
| 4,951,548 | A | 8/1990 | Wixon et al. | |
| 4,972,758 | A | 11/1990 | Austin et al. | |
| 5,115,713 | A * | 5/1992 | Muller et al. | 89/33.14 |
| 5,263,397 | A | 11/1993 | Sanderson | |
| 5,408,915 | A | 4/1995 | Stoner | |
| 6,152,012 | A | 11/2000 | Sherwood | |
| 6,164,180 | A | 12/2000 | Sulm et al. | |
| 6,339,983 | B1 | 1/2002 | Mannhart | |
| 6,345,562 | B1 * | 2/2002 | Mannhart | 89/33.16 |
| 6,439,098 | B1 | 8/2002 | Dillon | |
| 6,880,738 | B2 * | 4/2005 | Neumann et al. | 227/10 |
| 7,798,047 | B1 * | 9/2010 | Moody | 89/33.16 |
| 7,918,153 | B1 * | 4/2011 | Gordon et al. | 89/33.14 |
| 2002/0170420 | A1 * | 11/2002 | Falk | 89/33.16 |

OTHER PUBLICATIONS

United States Office Action, Office Action of Dec. 8, 2010, U.S. Appl. No. 12/050,610, 9 pages.

* cited by examiner

AMMUNITION MAGAZINE BOX WITH ADJUSTABLE TILTED INTERIOR BRACKET STRUCTURE

CROSS-REFERENCE TO RELATED APPLICATIONS

This application is a continuation of U.S. application Ser. No. 12/050,610 filed on Mar. 18, 2008, now U.S. Pat. No. 7,918,153 B1, entitled "Ammunition Magazine Box With Adjustable Tilted Interior Bracket Structure", now U.S. Pat. No. 7,918,153 issued on Apr. 5, 2011 which claims the benefit of U.S. Provisional Application Ser. No. 60/916,371 filed on May 7, 2007 and entitled "Ammunition Magazine Box With Adjustable Tilted Interior Bracket Structure", each of such prior applications being hereby incorporated herein by reference in its entirety.

BACKGROUND OF THE INVENTION

Belted ammunition for a machine gun is typically stored in a rectangular metal magazine box, with the ammunition belt being disposed within the magazine box in a vertically serpentined configuration with an outer end of the serpentined ammunition belt extending outwardly through an outlet opening of the magazine box and being connected to a feed mechanism portion of the gun. During firing of the gun, its feed mechanism pulls the belt outwardly through the outlet opening and fires, in rapid succession, the individual belted ammunition rounds delivered to the gun.

As is known in the armament art, the storage in and subsequent outfeed of belted ammunition from a magazine box of this general type may be subject to two types of potential problems—(1) the intermeshing of the projectile ends of the ammunition rounds in vertically successive lengths of the serpentined belted ammunition within the magazine box, which can cause a feed jam, and (2) the creation of a required ammunition outfeed pull force that exceeds the available pull force of the machine gun, which can prevent the gun from being fired.

From the foregoing it can be seen that a need exists for a machine gun belted ammunition magazine box that eliminates or at least substantially reduces these problems often associated with conventional machine gun magazine box designs. It is to this need that the present invention is primarily directed.

SUMMARY OF THE INVENTION

In carrying out principles of the present invention, in accordance with representative embodiments thereof, a belted machine gun ammunition magazine box is provided with an internal bay area in which a vertically serpentined length of belted ammunition may be stored for selective outfeed to a machine gun via a magazine box rear end opening.

In one representative embodiment of the invention, vertically successive end portions of the serpentined ammunition belt rest on a top side surface of an interior support bracket structure which is suitably secured within the bay, and is preferably length adjustable generally toward and away from the front end of the magazine box. Illustratively, but not by way of limitation, the support structure is formed from first and second telescoped bracket sections each having a generally inverted U-shaped configuration along its length, a laterally sloped top side wall, and means for releasably holding the telescoped bracket sections in a selected one of a plurality of different length-adjusted orientations. The top side surface of the support bracket structure is laterally sloped, in a direction transverse to the lengths of the vertically successive belt lengths, in a manner upwardly tilting the projectile ends of the ammunition rounds in the belt loop end portions resting on the top side surface of the support structure. This advantageously inhibits the intermeshing of projectile ends of rounds in vertically successive lengths of the belted ammunition within the magazine box which could potentially cause a feed jam.

Additionally, the top side surface of the support bracket structure, upon which rear end portions of the belt coils rest, is longitudinally sloped forwardly and downwardly from the rear ammunition outlet end of the magazine box. Because of this longitudinal sloping of the support bracket structure, both the weight and pull length, to an exit roller within the bay, of each downwardly successive belted ammunition length is progressively reduced to correspondingly reduce the maximum ammunition pull force which the machine gun must exert.

The length adjustability of the support bracket structure may be advantageously utilized to "fine tune" both the maximum gun pull force required to draw the entire supply of belted ammunition from the magazine box and also the maximum round capacity of the magazine box.

In a second representative embodiment of the invention, the interior support structure has a top side surface which is longitudinally sloped, but not laterally sloped, within the interior of the magazine box bay. This alternate positioning of the support bracket structure top side surface is useful in applications in which round "tilting" does not present a problem, but the maximum ammunition belt extraction force does.

In a third representative embodiment of the invention, the interior support bracket structure has a top side surface which is laterally sloped, but the support structure is installed within the magazine box bay in a manner such that the top side surface is not longitudinally sloped—i.e., it extends parallel to a bottom wall portion of the magazine box. This support structure is useful in applications wherein round "tilt" may be a problem, but maximum ammunition belt extraction force does not present a problem.

DETAILED DESCRIPTION

Figure 1:
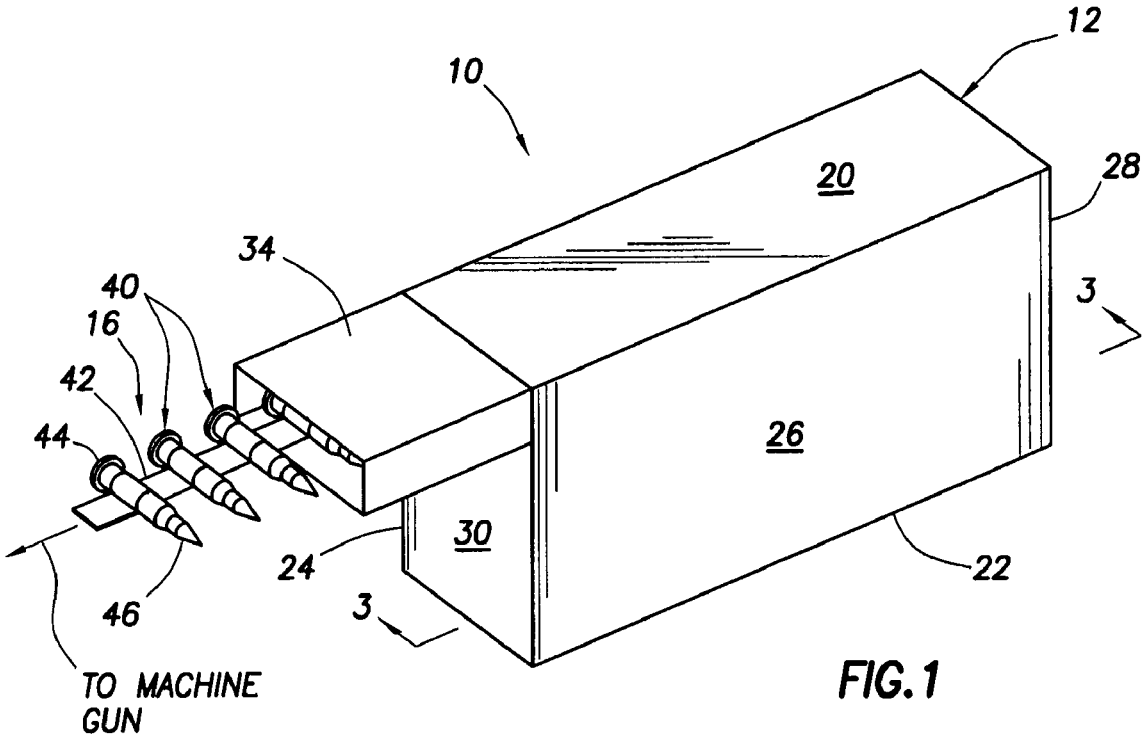
FIG. 1 is a schematic perspective view of the magazine box.
Figure 3:
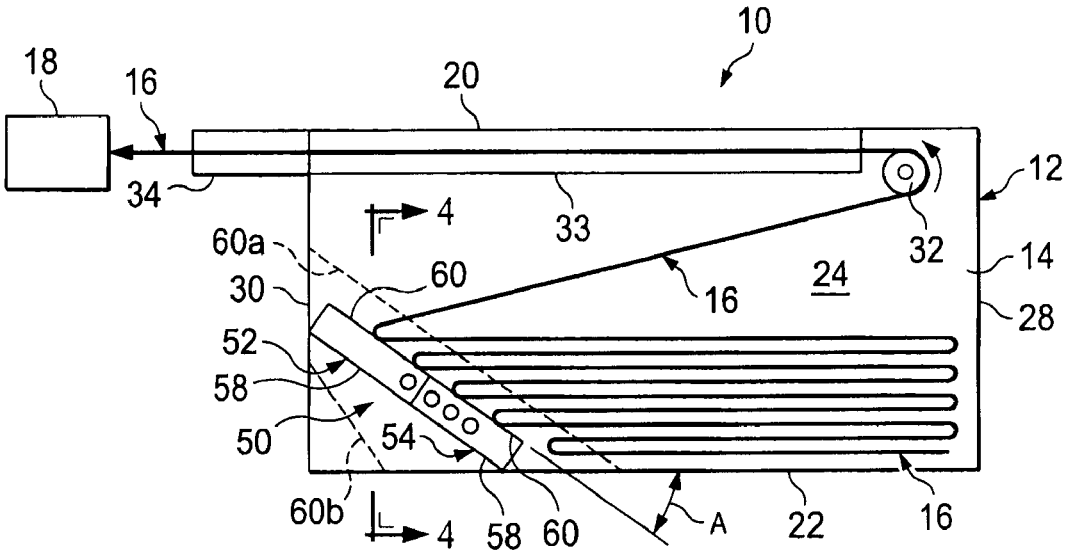
FIG. 3 is a schematic cross-sectional view, taken along line 3-3 of FIG. 1, through the magazine box with the bracket and a partial load of belted ammunition therein.

With initial reference to FIGS. 1 and 3, in a representatively illustrated embodiment thereof the present invention provides a specially designed belted machine gun ammunition magazine box 10 which has a horizontally elongated rectangular metal housing 12 that interiorly defines an ammunition bay 14 adapted to store, in a vertically serpentined arrangement, a length of belted machine gun ammunition 16 for selective outfeed from the bay 14 to a schematically depicted machine gun 18 which, during firing thereof, pulls the belted ammunition 16 into the gun in a conventional manner as indicated by the FIG. 3 arrowheads on the belted ammunition 16.

Housing 12 has opposite top and bottom walls 20 and 22, opposite vertical side walls 24 and 26, and opposite vertical front and rear end walls 28 and 30. Extending horizontally along a top interior portion of the bay 14, rearwardly of a roller 32 therein, is a feed tray 33 having a rear end that communicates with an external discharge feed chute 34 disposed at a top rear corner portion of the housing 12. As illustrated in FIG. 3, the top length of the vertically serpentined ammunition belt 16 is sequentially routed forwardly and upwardly around the feed roller 32, rearwardly through the feed tray and chute 33 and 34 and to the machine gun 18. During firing of the gun 18, each downwardly successive length of the serpentined belt 16 is pulled by the gun 18 outwardly from the bay 14 via this exit route.

Figure 4:
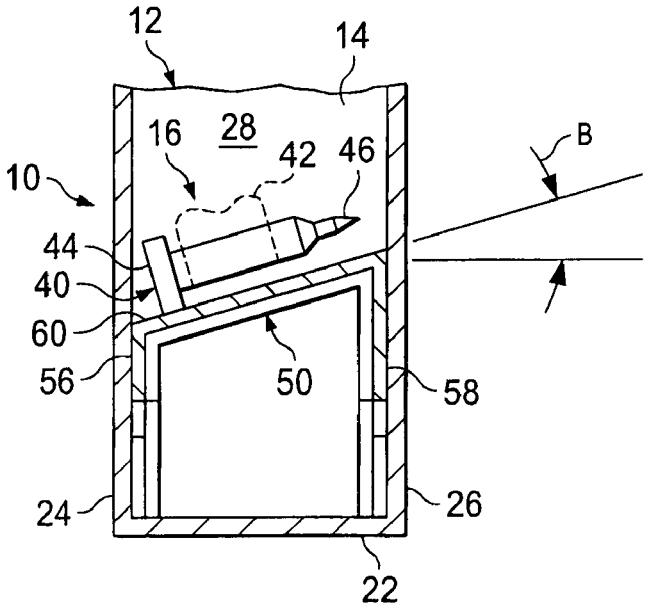
FIG. 4 is a schematic cross-sectional view through the magazine box taken along line 4-4 of FIG. 3.

Turning now to FIGS. 1 and 4, the ammunition belt 16 is of a conventional construction and comprises a series of parallel, laterally spaced ammunition rounds 40 releasably interconnected by a clip-based belt structure 42. Each round 40 has a casing end 44, to which the belt structure 42 is connected, and an opposite projectile end 46. Representatively, but not by way of limitation, with the belted ammunition 16 operatively stored in the magazine box 10, the projectile ends 46 face the vertical side wall 26 of the housing 12.

As is known in the armament art, the storage and subsequent outfeed of belted ammunition in a magazine box of this general type may be subject to two types of potential problems—(1) the intermeshing of the projectile ends 46 of rounds 40 in vertically successive lengths of the serpentined belted ammunition 16 within the magazine box 10, which can cause a feed jam, and (2) the creation of a required ammunition outfeed pull force that exceeds the available pull force of the machine gun, which can prevent the gun from being fired.

Figure 2:
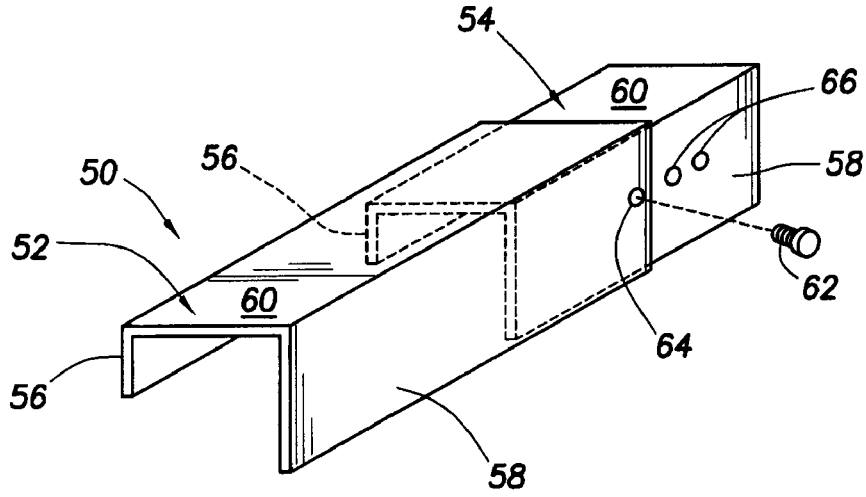
FIG. 2 is an enlarged scale perspective view of a length-adjustable interior support bracket structure incorporated in the magazine box.

In the present invention these two problems may be substantially eliminated using a specially designed internal support bracket structure 50 which is perspectively illustrated in FIG. 2. Representatively, the bracket structure 50 has an elongated, length-adjustable configuration and is defined by two telescoped, generally inverted U-shaped metal brackets 52 and 54, each having a relatively short vertical side wall 56, a vertically wider parallel opposite side wall 58, and a top wall 60 that laterally extends between the top edges of the walls 56,58 and is laterally sloped downwardly towards the side wall 56 at a preselected angle B (see FIG. 4) relative to a reference plane transverse to the parallel side walls 56,58. Illustratively, the bracket structure 50 is length-adjustable by inserting a retaining member, such as the screw 62 illustrated in FIG. 2, into a hole 64 in the side wall 58 of bracket 52 and an underlying one of a plurality of holes 66 formed in the underlying wall 58 of the bracket 54. With reference to FIGS. 3 and 4, the bottom housing wall 22 and the support bracket structure 50 collectively define a housing bottom wall structure, with the top bracket walls 60 forming a sloping top interior side portion of such housing bottom wall structure.

As illustrated in FIGS. 3 and 4, the bracket structure 50 is suitably secured within a rear bottom corner of the interior of the housing 12 with the bracket side walls 58 facing the housing side wall 26, and the laterally sloped bracket top walls 60 longitudinally sloped downwardly toward the front housing end wall 28 at a suitable angle A (see FIG. 3) relative to the bottom wall 22 of the housing 12. With the bracket structure 50 installed in this orientation within the interior of the housing 12, it can be seen that the rear ends of the stacked ammunition belt loops, and the ammunition rounds 40 therein, rest upon the longitudinally and laterally sloped top wall portions 60 of the interior bracket structure 50.

As can be seen in FIG. 4, this causes the ammunition rounds 40 in such rear ends of the belt loops to be tilted upwardly from horizontal at the selected angle B. This, in turn substantially inhibits the projectile ends 46 of the rounds 40 in each belt layer from tipping downwardly toward the rounds in the underlying belt layer and becoming intermeshed therewith in a manner potentially causing a feed jam within the magazine box 10.

The longitudinal sloping of the installed bracket structure 50 serves to advantageously reduce the pull force which the gun 18 must exert to pull each belt layer out of the magazine box 12. As can be seen, since the top bracket walls 60 slope forwardly and downwardly, both the weight and pull length (to the roller 32) of each downwardly successive belted ammunition layer is progressively reduced to correspondingly reduce the maximum ammunition pull force which the machine gun 18 must exert. The illustrated length adjustability of the interior bracket support structure 50 permits its upper wall portion 50 to be positioned within the housing 12 at selectively variable longitudinal slopes as, for example, illustrated by the dashed lines 60*a*,60*b* in FIG. 3. This longitudinal slope adjustability may be advantageously utilized to "fine tune" both the maximum gun pull force required to draw the entire supply of belted ammunition from the magazine box 10 and also the maximum round capacity thereof.

While the length adjustability of the longitudinally and laterally sloped bracket structure 50 permits these adjustments to be made using a single bracket structure, it will be appreciated by those of skill in this particular art that the same effects could also be achieved using a series of different, fixed length interior bracket structures, installing a selected one within the housing 12 to suit the ammunition feed needs of the magazine box 10.

Figure 4A:
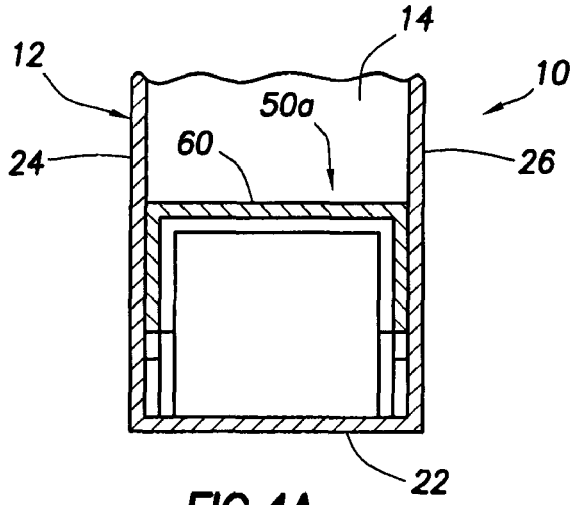
FIG. 4A is a view similar to that in FIG. 4, but illustrating an alternate embodiment of the support bracket structure in which its top side wall is not laterally sloped.

As described above, the top wall portions 60 of the representatively illustrated interior support bracket structure 50 within the interior of the magazine box housing 12 are both laterally and longitudinally sloped. However, an alternatively configured bracket structure 50*a*, as schematically illustrated in FIG. 4A, may be provided and installed within the interior of the housing 12, bracket structure 50*a* having a top wall portion 60 which is longitudinally sloped within the housing interior, but is not laterally sloped (for example, for use in applications where the previously described round "tilting" does not present an operational feed problem).

Figure 5:
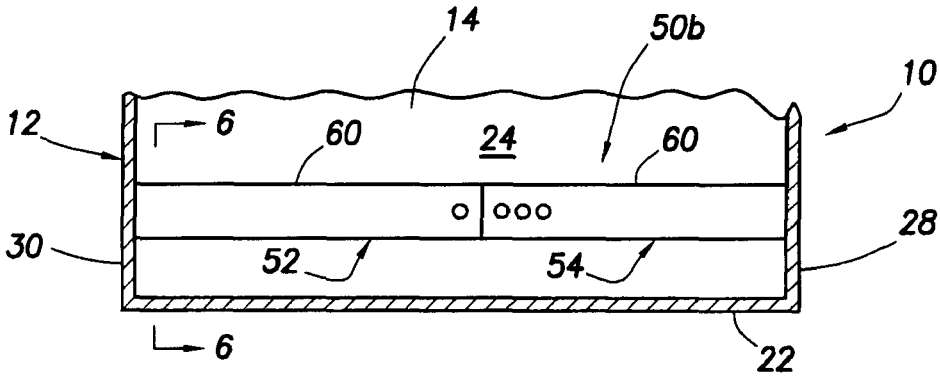
FIG. 5 is a schematic cross-sectional view through a bottom portion of the magazine box with an alternate embodiment of the support bracket structure installed therein and longitudinally extending along the entire length of its interior.
Figure 6:
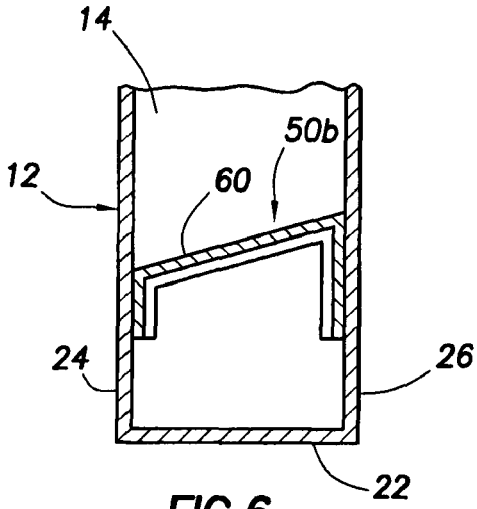
FIG. 6 is a schematic cross-sectional view through the magazine box taken along line 6-6 of FIG. 5.

FIGS. 5 and 6 schematically depict a second alternate embodiment 50*b* of the previously described interior support bracket structure 50. In the bracket structure 50*b* the top wall portion 60 is laterally sloped, but the bracket structure 50*b* is installed within the housing 12 in a manner such that the laterally sloped top wall portion 60 of the bracket structure 50*b* is not longitudinally sloped—i.e., extends parallel to the bottom housing wall 22. This interior bracket orientation is useful in applications wherein round "tilt" may be a problem, but maximum ammunition belt extraction force does not present a problem.

While the various interior bracket support structures representatively illustrated and described herein have generally inverted U-shaped cross-sections along their lengths, various other cross-sections could alternatively be utilized without departing from principles of the present invention. Moreover, a single bay ammunition magazine box has been illustrated and described for sake of descriptive simplicity. However, as will be readily appreciated by those of skill in this particular art, principles of the present invention may also be applied to magazine box structures having a plurality of ammunition bays.

The foregoing detailed description is to be clearly understood as being given by way of illustration and example only, the spirit and scope of the present invention being limited solely by the appended claims.

What is claimed is:

1. Machine gun ammunition apparatus comprising a belted machine gun ammunition magazine box having:

a top wall;

first and second opposed end walls extending downwardly from said top wall;

first and second opposed side walls extending downwardly from said top wall and between said first and second opposed end walls;

a belted ammunition outfeed opening, extending outwardly through an upper portion of said magazine box, through which belted ammunition may be fed from within said magazine box to a machine gun; and a bottom wall structure having a top interior side portion sloping downwardly from one of said first and second side walls toward the other of said first and second side walls, said magazine box being configured to receive and operatively support a vertically serpentined length of belted ammunition having vertically successive belt lengths, each of the vertically successive belt lengths longitudinally extending transversely to said first and second opposed end walls and carrying ammunition rounds with projectile end portions, in a manner such that at least end portions of the belt lengths rest on said top interior side portion of said bottom wall structure with at least some of the ammunition round projectile end portions in vertically successive ones of the belt lengths being upwardly tilted to inhibit potential feed jam-creating intermeshing of such projectile end portions, and wherein said bottom wall structure comprises:

a bottom wall, and a support structure secured within an interior bottom corner portion of said magazine box and defining said top interior side portion.

2. The machine gun ammunition apparatus of claim 1 further comprising:

a length of vertically serpentined belted ammunition received and operatively supported in said magazine box.

3. The machine gun ammunition apparatus of claim 1 wherein:

said support structure is removably secured within said magazine box, has a length generally parallel to said first and second opposed side walls, and is length-adjustable to adjust the slope of said top interior side portion.

4. Machine gun ammunition apparatus comprising a belted machine gun ammunition magazine box having:

a top wall;

first and second opposed end walls extending downwardly from said top wall;

first and second opposed side walls extending downwardly from said top wall and between said first and second opposed end walls;

a belted ammunition outfeed opening, extending outwardly through an upper portion of said magazine box, through which belted ammunition may be fed from within said magazine box to a machine gun; and a bottom wall structure having a top interior side portion sloping downwardly from one of said first and second side walls toward the other of said first and second side walls, said magazine box being configured to receive and operatively support a vertically serpentined length of belted ammunition having vertically successive belt lengths, each longitudinally extending transversely to said first and second opposed end walls and carrying ammunition rounds with projectile end portions, in a manner such that at least end portions of the belt lengths rest on said top interior side portion of said bottom wall structure with at least some of the ammunition round projectile end portions in vertically successive ones of the belt lengths being upwardly tilted to inhibit potential feed jam-creating intermeshing of such projectile end portions, said top interior side portion further sloping downwardly from one of said first and second end walls toward the other of said first and second end walls to thereby reduce the total ammunition pull force which a machine gun must exert to extract belted ammunition from said magazine box.

5. The machine gun ammunition apparatus of claim 4 further comprising:

a length of vertically serpentined belted ammunition received and operatively supported in said magazine box.

6. The machine gun ammunition apparatus of claim 4 wherein said bottom wall structure comprises:

a bottom wall, and a support structure secured within an interior bottom corner portion of said magazine box and defining said top interior side portion.

7. The machine gun ammunition apparatus of claim 4 wherein:

said support structure is removably secured within said magazine box, has a length generally parallel to said first and second opposed side walls, and is length-adjustable to adjust the slope of said top interior side portion.

8. Machine gun ammunition apparatus comprising a belted machine gun ammunition magazine box having:

a top wall;

first and second opposed end walls extending downwardly from said top wall;

first and second opposed side walls extending downwardly from said top wall and between said first and second opposed end walls;

a belted ammunition outfeed opening, extending outwardly through an upper portion of said magazine box, through which belted ammunition may be fed from within said magazine box to a machine gun; and a bottom wall structure having a top interior side portion sloping downwardly from one of said first and second end walls toward the other of said first and second end walls, said magazine box being configured to receive and operatively support a vertically serpentined length of belted ammunition having vertically successive belt lengths, each of the vertically successive belt lengths longitudinally extending transversely to said first and second opposed end walls, in a manner such that at least end portions of the belt lengths rest on said top interior side portion of said bottom wall structure to thereby reduce the total ammunition pull force which a machine gun must exert to extract belted ammunition from said magazine box, the length of each downwardly successive belt length being longitudinally reduced relative to the upwardly preceding belt length.

9. The machine gun ammunition apparatus of claim 8 further comprising:

a length of vertically serpentined belted ammunition received and operatively supported in said magazine box.

10. The machine gun ammunition apparatus of claim 8 wherein said bottom wall structure comprises:

a bottom wall, and a support structure secured within an interior bottom corner portion of said magazine box and defining said top interior side portion.

11. The machine gun ammunition apparatus of claim 10 wherein:

said support structure is removably secured within said magazine box, has a length generally parallel to said first and second opposed side walls, and is length-adjustable to adjust the slope of said top interior side portion.

12. A method of storing belted machine gun ammunition, comprising:

providing an ammunition box having a top wall, first and second opposed end walls extending downwardly from said top wall, first and second opposed side walls extending downwardly from said top wall and between said first and second opposed end walls, a belted ammunition outfeed opening, extending outwardly through an upper portion of said magazine box, through which belted ammunition may be fed from within said magazine box to a machine gun, and a bottom wall structure having a top interior side portion sloping downwardly from one of said first and second side walls toward the other of said first and second side walls, said bottom wall structure comprising a bottom wall, and a support structure secured within an interior bottom corner portion of said magazine box and defining said top interior side portion; and operatively disposing within said magazine box a vertically serpentined length of belted machine gun ammunition, having vertically successive belt lengths each carrying ammunition rounds with projectile end portions, in a manner such that at least end portions of said belt lengths rest on said top interior side portion of said bottom wall structure with at least some of said ammunition round projectile end portions in vertically successive ones of said belt lengths being upwardly tilted to inhibit potential feed jam-creating intermeshing of such projectile end portions.

13. The method of claim 12 further comprising:

causing said top interior side portion of said bottom wall structure to additionally slope downwardly from one of said first and second end walls toward the other of said first and second end walls in a manner such that the total ammunition pull force which a machine gun must exert to extract belted ammunition from said magazine box is substantially reduced.

14. A method of storing belted machine gun ammunition, comprising:

providing an ammunition box having a top wall, first and second opposed end walls extending downwardly from said top wall, first and second opposed side walls extending downwardly from said top wall and between said first and second opposed end walls, a belted ammunition outfeed opening, extending outwardly through an upper portion of said magazine box, through which belted ammunition may be fed from within said magazine box to a machine gun, and a bottom wall structure having a top interior side portion sloping downwardly from one of said first and second end walls toward the other of said first and second end walls; and operatively disposing within said magazine box a vertically serpentined length of belted machine gun ammunition having vertically successive belt lengths in a manner such that at least end portions of said belt lengths rest on said top interior side portion of said bottom wall structure to thereby reduce the total ammunition pull force which a machine gun must exert to extract belted ammunition from said magazine box, the length of each downwardly successive belt length being longitudinally reduced relative to the upwardly preceding belt length.

15. A method of storing belted machine gun ammunition, comprising:

providing an ammunition box having a top wall, first and second opposed end walls extending downwardly from said top wall, first and second opposed side walls extending downwardly from said top wall and between said first and second opposed end walls, a belted ammunition outfeed opening, extending outwardly through an upper portion of said magazine box, through which belted ammunition may be fed from within said magazine box to a machine gun, and a bottom wall structure having a top interior side portion sloping downwardly from one of said first and second side walls toward the other of said first and second side walls; and operatively disposing within said magazine box a vertically serpentined length of belted machine gun ammunition having vertically successive belt lengths in a manner such that at least end portions of said belt lengths rest on said top interior side portion of said bottom wall structure with said end portions of said belt lengths being angularly offset, about axes extending between said first and second opposed end walls, relative to the longitudinal balances of said belt lengths.

* * * * *